United States Patent [19]

Childs

[11] 4,363,349

[45] Dec. 14, 1982

[54] SASH PORTLIGHT FOR MARINE USE

[76] Inventor: John M. Childs, 13031 Deva St., Coral Gables, Fla. 33156

[21] Appl. No.: 202,274

[22] Filed: Oct. 30, 1980

[51] Int. Cl.[3] ..... E06B 9/00; E06B 5/00; E06B 3/60

[52] U.S. Cl. ..... 160/90; 49/463

[58] Field of Search ..... 160/90, 92, 91; 49/463; 52/476, 208, 209, 302, 305, 656, 122; 40/152

[56] References Cited

U.S. PATENT DOCUMENTS

| | | | |
|---|---|---|---|
| 2,570,714 | 10/1951 | Robinson | 49/463 |
| 2,572,764 | 10/1951 | Rogers et al. | 52/202 |
| 2,580,957 | 1/1952 | Reeves | 49/463 |
| 2,606,346 | 8/1952 | Hassel | 160/92 X |
| 2,705,819 | 4/1955 | Gellert et al. | 52/209 |
| 3,184,801 | 5/1965 | Fletcher | 52/209 X |
| 3,358,576 | 12/1967 | Kelly et al. | 160/92 |
| 3,994,243 | 11/1976 | Anders | 52/208 X |
| 4,026,082 | 5/1977 | Crofoot | 52/302 |

FOREIGN PATENT DOCUMENTS

| | | | |
|---|---|---|---|
| 705897 | 4/1941 | Fed. Rep. of Germany | 49/463 |

*Primary Examiner*—Peter M. Caun
*Assistant Examiner*—Cherney S. Lieberman
*Attorney, Agent, or Firm*—Ernest H. Schmidt

[57] ABSTRACT

An integrally-formed sash portlight for installation through a side-wall opening in the cabin or hull structure of a marine vessel has an inwardly-projecting, rectangular, spigot portion within which a rectangular light or screen can be selectively fitted. The spigot portion is provided along the inside top with a side-to-side groove within which an upper marginal edge portion of either the light or framed screen can be received, selectively, and along the inside bottom with a vertically opposed side-to-side seat for the seating reception, selectively, of a lower marginal edge portion of the light or screen, said seat being angularly inclined along its length in the downward direction from inside to the outside, and said lower marginal edge of said light and screen being beveled to the same angle as said seat so as to be in substantially face-to-face contact therewith upon installation in the portlight frame, whereby water impinging on the outside of said light when installed in the portlight frame will be shed downwardly and outwardly of the vessel in which the portlight is installed.

9 Claims, 5 Drawing Figures

SASH PORTLIGHT FOR MARINE USE

BACKGROUND OF THE INVENTION

This invention relates to marine portlights, and is directed particularly to sash portlights for above water installation providing for selective use of either a light or a screen, as desired.

The use of window sashes or frames in which windows or screens can be installed for use either independently or in combinatin are well known in building construction.

U.S. Pat. No. 2,572,764 to Rogers et al and No. 3,190,348 to Migneault et al, for example, describe window sashes in building construction wherein screening or window glass is removably installed in a sash or frame by upward movement of a top marginal edge portion in a frame header groove for clearance of the bottom edge over a frame sill seat for seating thereupon to retain the glass or screen unit in place, the groove in the header being deep enough to retain the upper edge portion after such seating of the lower edge of either the window glass or screen unit. Such known windows, however, are not readily adaptable to marine use because of the vastly difference conditions of usage and installation in the marine setting. It is, accordingly, the principal object of this invention to provide a novel and improved sash portlight for marine use, particularly for use in pleasure boats, yachts, and other relatively small ocean going vessels.

A more particular object of the invention is to provide a sash portlight of the above nature which, although not adapted for submersible use, is substantially water-tight and provides for self-drainage from the outside.

Another object of the invention is to provide a sash portlight of the character described wherein installation is made through a side-wall opening in a vessel from the outside, and wherein a sash light or screen, upon assembly, is received within a groove at the inside upper end of a peripheral flange comprising the portlight for seating against a downwardly and outwardly inclined surface along the bottom of the portlight frame so as to shed water to the outside, the lower edge of the light or screen to be selectively installed being beveled at the same angle as the inclined surface against which its seats so as to fit in face-to-face abutting engagement upon installation.

Yet another object is to provide a sash portlight of the character described wherein the peripheral flange is integrally formed with the portlight frame, whereby the pressure of water impinging against the outside of the light fitted in the frame will be transferred through the frame to the outside of the vessel hull, thereby obviating any tendency to loosen the sash light frame, as might otherwise occur in constructions wherein the frame flange is secured against the inside of the hull opening.

Other objects are to provide sash portlight which will be simple in construction, economical to manufacture, easy to install and operate, and durable and attractive in use.

Still other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figure 1:
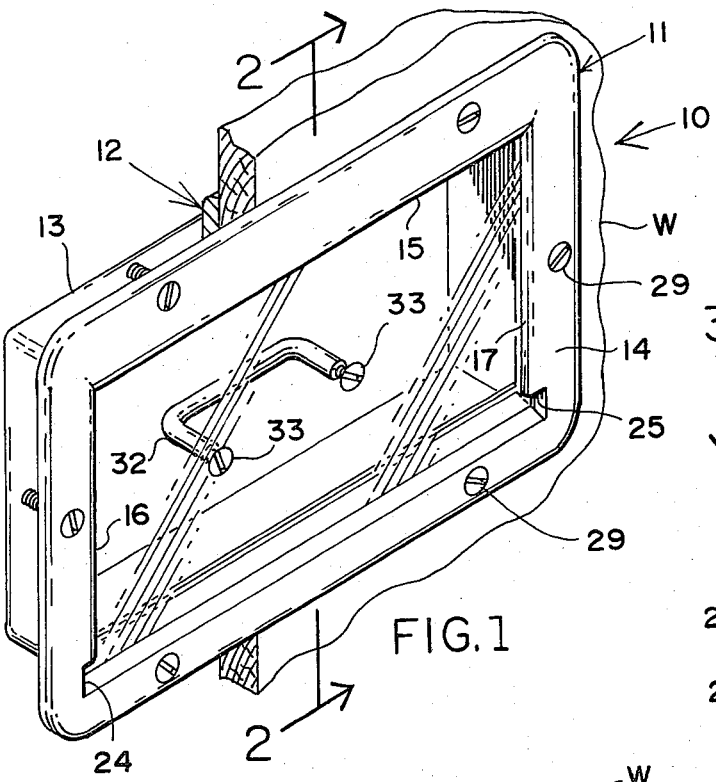
FIG. 1 is an oblique view, as viewed from above and from the outside, of the sash portlight embodying the invention, showing cut away portions of the cabin side-wall structure in which it is installed.

Referring now in detail to the drawings, reference numeral 10 designates, generally, a sash portlight embodying the invention, shown installed in the side-wall W (partially illustrated) of the cabin, for example, of a marine vessel. The sash portlight 10 comprises a frame member 11 and an inner trim ring 12, each preferably fabricated of a tough, substantially rigid, synthetic plastic material such as Nylon. The frame member 11 comprises a tubular spigot portion 13, of rectangular shape, integrally formed about its outer periphery with a perpendicularly-outwardly-extending flange 14. As best illustrated in FIGS. 1, 2 and 3, the peripheral flange 14 is integrally formed along the top, and along ech side with perpendicularly-inwardly-extending flange portions 15, 16 and 17, respectively, serving as abutment surfaces for the light 18 (see FIG. 2) or screen 19 (see FIGS. 4 and 5), selectively, installed in the manner hereinafter more particularly described.

Figure 2:
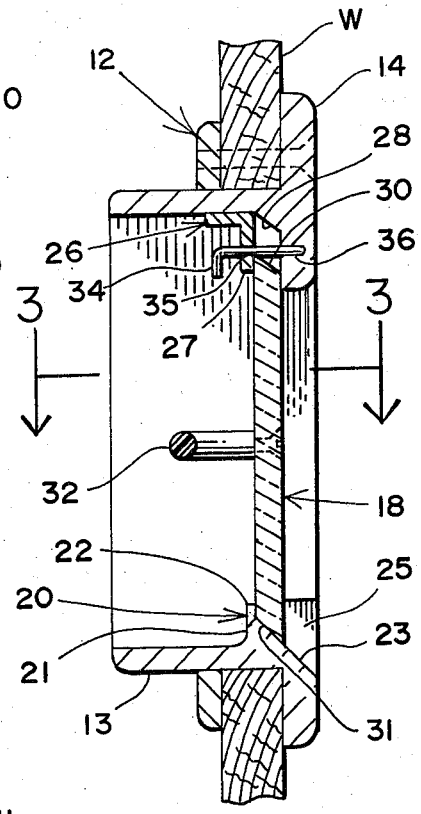
FIG. 2 is a vertical, cross-sectional view, taken along the plane indicated at 2—2 of FIG. 1 in the direction of the arrows.
Figure 3:
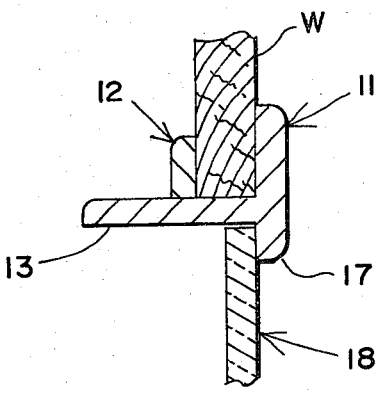
FIG. 3 is a transverse, cross-sectional view, taken along the plane indicated at 3—3 of FIG. 2 in the direction of the arrows.

As best illustrated in FIGS. 1 and 2, the bottom wall of the tubular spigot portion 13 of frame member 11, at its inside, is integrally fpormed along its length with an upstanding seat portion 20 which defines, in transverse cross-section, an upwardly-extending, inner wall portion 21, a relatively short rectangular, upper end portion 22, and a downwardly and outwardly-extending, beveled portion 23 the angular planar surface of which extends through to the outer surface of flange 14, along the bottom portion thereof. Lower end portions of side flange portions 16 and 17 preferably are notched or cut away to the inner side-wall surfaces of spigot portion 13, as indicated at 24 and 25 in FIG. 1, to facilitate integral molding of frame member 11 with the employment of standard injection molding techniques.

Figure 4:
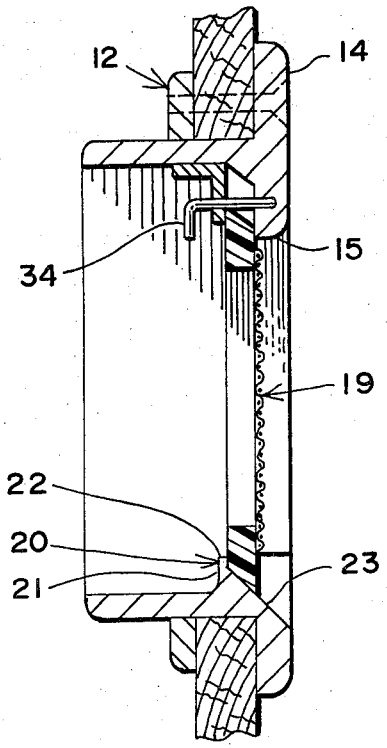
FIG. 4 is a vertical, cross-sectional view, similar to that of FIG. 2 but illustrating the replacement of the light with a screen.
Figure 5:
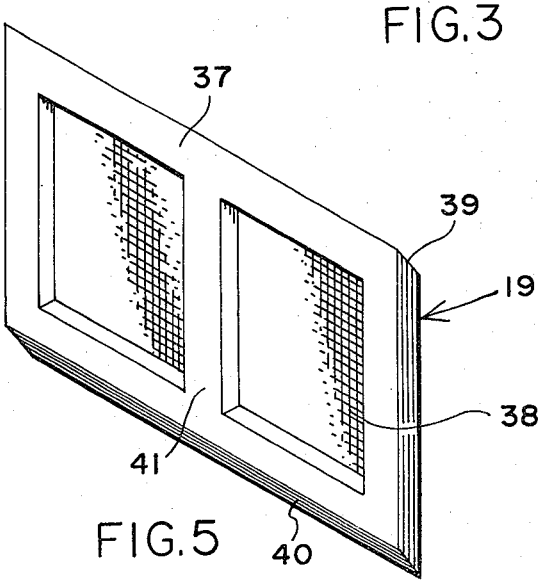
FIG. 5 is an oblique view of the screen, shown separately.

As illustrated in FIGS. 2 and 4, a right-angular bracket 26, also preferably fabricated of tough synthetic plastic material, is secured along the top, inner surface of frame spigot portion 13, the downwardly-extending leg 27 of said bracket being in spced, parallel relation with respect to the inner, vertical surface of the adjacent flange 14. The bracket 26, secured in place by a suitable adhesive, preferably extends the full length from side-to-side between the inner walls of frame member spigot portion 13, and defines a longitudinal slot 28 within which an upper, marginal edge portion of either the light 18 or the screen 19 is received, selectively, as is hereinafter described.

As illustrated in FIGS. 1 through 4, the sash portlight is installed by passing tubular spigot portion 13 through an opening in the side-wall W of the cabin or hull of the vessel so that the outer flange 14 abuts a marginal peripheral zone at the outer surface of the opening. The rectangular trim ring 12 fits over the frame spigot portion 13 at the inside, and is clamped to flange 14 by a plurality of bolts 29, thereby sandwiching a peripheral marginal zone of the hull or cabin opening thereinbetween.

As illustrated in FIGS. 1 and 2, the light 18 is preferably fabricated of clear Plexiglass, and, is rectangular in shape, the width being slightly less than the distance between the inner surfaces of the side-walls of frame member spigot portion 13 so as to fit thereinbetween. The upper and lower edges of the light 18 are beveled from inside downward to the outside, as indicated at 30 and 31, respectively, in FIG. 2, at an angle of approximately 45°. The overall height of the light 18 from the angular tip at the upper end to the angular tip at the lower end is slightly less than the distance between the upper inner surface of frame member tubular spigot portion 13 and the upper end of the upstanding seat portion 20 at the lower side of said frame member spigot portion 13. The rectangular light 18 therefore can be installed as a window sash simply by inserting its upper end within the longitudinal slot 28, as described above, to its full extent, after which its lower end can be passed over seat portion 20 and into abutment against the insides of inwardly-extending side flange portions 16 and 17 to enable downward movement for seating at its lower end against angular surface 23 of said seat portion in back of rectangular upper end portion 22 thereof. To facilitate such insertion and removal of the sash light 19, a U-shaped handle 32, or the like, will preferably be secured to a central portion at the inside thereof, to be held in place by a pair of machine screws 33, for example. As further illustrated in FIG. 2, once the sash light 18 has been installed as described above, it can be secured in place by a locking pin 34, insertable through aligned openings 35, 36 in the downwardly-extending leg 27 of bracket 26 and top flange portion 15 of flange 14, respectively. It will be understood that the locking pin 34, upon installation, passes just above the upper edge of seated sash light 18 to prevent its upward movement, thereby locking it in place within the frame member 11.

FIG. 4 illustrates how the screen 19 can be substituted for the sash light 18 after said light has been removed by reversal of the installation and locking procedure described above. The screen 19, which is illustrated separately in FIG. 5, comprises a molded, rectangular frame 37, of the same size and peripheral shape of the sash light 18, against which screening 38 is cemented or otherwise affixed. It is of the same rectangular shape and thickness as that of the sash light 18, and is similarly beveled along its upper and lower edges, as indicated at 39 and 40, respectively. The screen frame 37 is integrally formed with a central, vertical, support post portion 41, which serves as a handle for the insertion and removal of the screen 19 in the sash portlight frame.

In use, it will be understood that the sash portlight, when installed with sash light 18, is substantially watertight, since water striking the outside of the light will flow downwardly along the outer surface to be shed outwardly at the bottom along the angular surface 23 at the lower end of the frame 11.

The pressure of water striking the light from the outside, moreover, will be transferred through the portlight frame flange against the outside marginal periphery of the hull opening in which the portlight is installed, thereby precluding any tendency to losen, as might otherwise occur with ordinary portlights of the type wherein the framework is mounted and secured such as by screws or bolts against the inside of the hull portlight opening.

While I have illustrated and described herein only one form in which the invention can be conveniently embodied in practice, it is to be understood that this embodiment is presented by way of example only, and not in a limiting sense. The invention, in brief, comprises all the embodiments and modifications coming within the scope and spirit of the following claims.

What I claim as new and desire to secure by Letters Patent is:

1. A sash portlight for marine use, comprising, in combination, a rectangular frame member, said frame member being integrally formed with a tubular spigot portion defining a rectangular through opening, said tubular spigot portion having integrally formed therewith, about its outer periphery, a perpendicularly-outwardly-extending flange, a rectangular sash light receivable within the said rectangular through opening, said flange comprising a perpendicularly-inwardly-extending top portion and opposed perpendicularly-inwardly-extending side portions serving as abutment surfaces for marginal outer surface portions of said sash light upon installation in said frame member, means defining a longitudinal groove at the inside upper wall portion of said spigot portion and comprising said perpendicularly-inwardly-extending top portion of said flange, means along the inside lower wall portion of said spigot portion and extending upwardly thereof for seating a lower marginal end portion of said rectangular sash light upon its installation in said frame member, said seating means being vertically opposed to said longitudinal groove means, the width of said longitudinal groove and the top-to-bottom overall height of said sash light being such as to permit the insertion of an upper marginal portion of said light upwardly within said longitudinal groove and a lower marginal portion thereof over said seating means for placement in abutment with said abutment surfaces and, after subsequent downward movement, in abutting engagement with said seating means for the retention in place of said sash light in said frame member, said seating means comprising a rectangular upper end portion merging, at the outside, with a longitudinally-extending, downwardly and outwardly-directed, beveled surface portion extending through to the outer surface of the bottom portion of said flange, said sash light being beveled along its lower edge to define an angle of inclination substantially equal to that of said beveled surface portion, whereby, upon the seating of said sash light in place upon its installation in said frame, its beveled edge will seat face-to-face in abutting engagement against said beveled surface portion of said seating means.

2. A sash portlight as defined in claim 1 wherein said means defining a longitudinal groove comprises a bracket secured along an inside upper wall portion of said spigot portion and comprising a downwardly-extending leg portion disposed in spaced, parallel relation with respect to the inner surface of said perpendicularly-inwardly-extending top portion of said flange, and means for removably securing said light in its installed and seated position.

3. A sash portlight as defined in claim 2 including a screen member of substantially the same rectangular size as said sash light and receivable, selectively, within said longitudinal groove and in abutting engagement with said seating means for installation in said frame member in place of said sash light.

4. A sash portlight as defined in claim 3 wherein said screen member comprises a rectangular screen frame having an integrally formed central post, and a screen the peripheral edge of which is secured against the outside of said screen frame, whereby said post can be grasped from the inside for the removal and replacement of said screen member in said frame member.

5. A sash portlight as defined in claim 3 wherein lower end portions of said side portions of said flange are cut away to the inner side-wall surfaces of said spigot portion.

6. A sash portlight as defined in claim 2 wherein said securing means comprises a locking pin removably receivable in aligned openings in said downwardly-extending leg portion of said bracket and said perpendicularly-inwardly-extending top portion of said flange.

7. A sash portlight as defined in claim 1 wherein said sash light is beveled along its upper edge at the same angle of inclination as its lower beveled edge.

8. A sash portlight as defined in claim 7 including a handle fixed against one side of said sash light to facilitate manual installation and removal with respect to said frame member.

9. A sash portlight as defined in claim 1 and further including a trim ring having a central rectangular opening for close fit circumjacent said spigot portion.

* * * * *